United States Patent [19]

Hollingsworth et al.

[11] Patent Number: 4,953,264

[45] Date of Patent: Sep. 4, 1990

[54] METALLIC WIRE USED WITH TEXTILE FIBER PROCESSING ELEMENTS, IN PARTICULAR, WITH CLEANING ROLLERS

[75] Inventors: John D. Hollingsworth, Greenville, S.C.; Akiva Pinto, Gastonia, N.C.

[73] Assignee: John D. Hollingsworth on Wheels, Inc., Greenville, S.C.

[21] Appl. No.: 209,016

[22] Filed: Jun. 20, 1988

[30] Foreign Application Priority Data

Jul. 18, 1987 [DE] Fed. Rep. of Germany ..... 3723872

[51] Int. Cl.[5] ..... D01G 15/84

[52] U.S. Cl. ..... 19/114

[58] Field of Search ..... 19/97, 112, 113, 114, 19/202

[56] References Cited

U.S. PATENT DOCUMENTS

| | | | |
|---|---|---|---|
| 2,731,676 | 1/1956 | Apthorp | 19/114 |
| 2,937,413 | 5/1960 | Hollingsworth | 19/114 |
| 3,204,297 | 9/1965 | Wada | 19/114 |

FOREIGN PATENT DOCUMENTS

| | | | |
|---|---|---|---|
| 7008523 | 2/1987 | Japan | 19/114 |

*Primary Examiner*—Werner H. Schroeder
*Assistant Examiner*—D. Price
*Attorney, Agent, or Firm*—Cort Flint

[57] ABSTRACT

Metallic toothed wire is disclosed for textile fibers processing elements for processing cotton, synthetic fibers and the like, and particularly for use with cleaning rollers in which the surface is clothed with the toothed wire. The toothed wire comprises a plurality of teeth having a tooth distance (4,17) between the teeth (3,16) in a circumferential direction of at least 10 mm. The teeth (3,16) have a height which extends to about one third of the tooth distance, and preferably no more than 3 mm. The teeth have an ascending rear portion (5,20) which ascends in a rear inclination over about half the tooth distance from a tooth base (9,19) to a tooth tip. An undercut portion (8,21) which has an undercut inclination extends downwardly from the tooth tip to the base. A positive front angle (7,23) is between the rear inclination and the undercut inclination within a range of 10 degrees to 40 degrees. A trough interspace (26) is defined between the undercut portions and tooth bases of adjacent teeth (3,16) for receiving waste particles from fiber cleaning of substantial length which are not broken or comminuted.

22 Claims, 1 Drawing Sheet

FIG.1
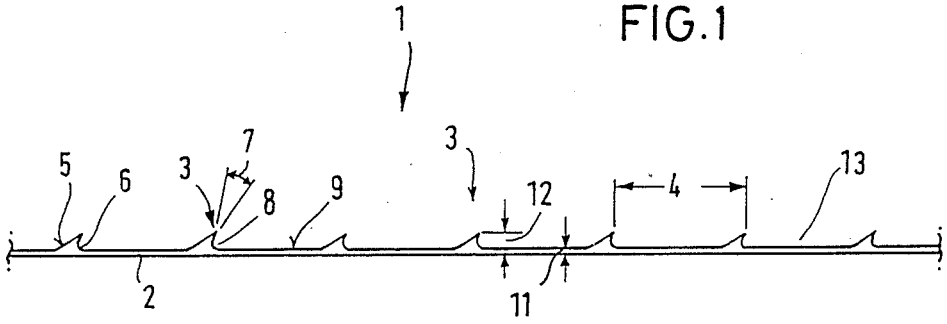
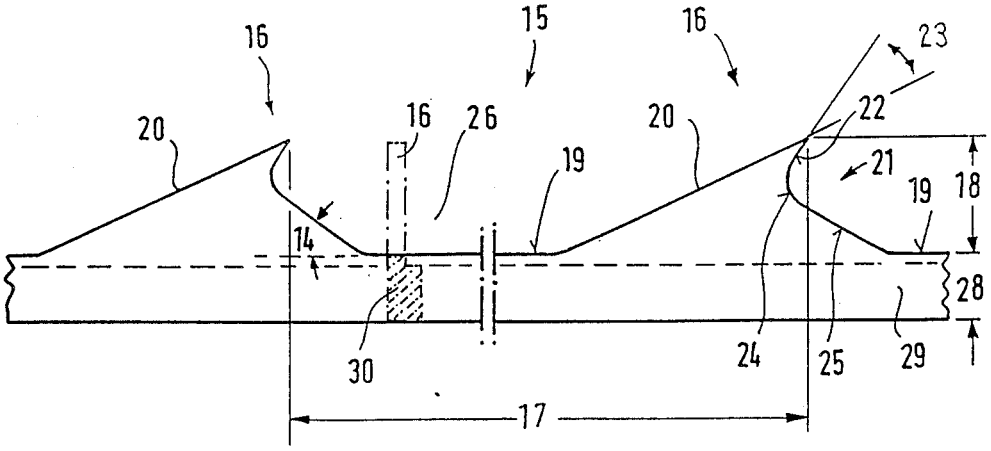
FIG.2

METALLIC WIRE USED WITH TEXTILE FIBER PROCESSING ELEMENTS, IN PARTICULAR, WITH CLEANING ROLLERS

BACKGROUND OF THE INVENTION

The invention relates to a metallic wire on rollers, plates, or the like for processing textile fibers such as cotton, synthetic fibers, etc. In particular, the metallic wires may be used for cleaning rollers, in which the surface of the roller, plates, or the like is to be provided with a toothed wire.

It has been known to provide textile fiber processing elements such as rollers, cards, cleaning machines, etc., with a metallic wire. The saw tooth wire comprises teeth in a relatively close sequence, for example, three to four consecutive teeth in a space of 25 mm, so that the distance between the teeth on the tooth wire is about 6 to 8 mm. The thickness of the tooth wire, i.e., the wire selvedge, frequently exceeds 3 mm. A metallic wire designed this way is used to open fiber bales and to obtain a more or less loose fiber mat with satisfactory results. The fiber material presented to the rollers is rarely cleaned thoroughly and still contains impurities. The wire has to process fiber material being more or less contaminated by husks, stalks, stalk portions, etc. In case of the known wire, impurity particles are often torn or broken and may be removed but only with difficulty from the fiber material by means of a blade grid or the like. The breaking of the waste particles is accompanied by the formation of dust which sticks to the carded fiber material. Smallest waste particles form the so-called neps which are hardly removable from the processed and completely opened fiber material. Use is made also of tooth shapes corresponding to the opening rollers and serving nearly exclusively for the cleaning of the fiber material.

It is an object of the present invention to provide a metallic wire for textile fiber processing elements by which it is possible to considerably improve and increase the quality of the cleaning operation of the fiber material during the opening or fine opening of the fibers.

SUMMARY OF THE INVENTION

The above objective is accomplished according to the invention in that the teeth of the tooth wire are spaced mutually at least by 12 mm in a peripheral direction. The teeth are as high as about one third of the distance between them. The tooth ascends substantially from its base at half the tooth distance to the tip to subsequently have an undercut design. The tooth tip has a positive front angle within the range of 10 degrees to 40 degrees from the ascending rear inclination to the undercut inclination. Preferably, the distance between the teeth should be maintained between 12 mm and 30 mm. A distance of 20 mm to 25 mm is regarded as a favorable average measure. Suitably, the height of the teeth is less than 3 mm, preferably within the range of about 2 mm to 2.5 mm.

As a result of such a metallic wire design for the cleaning and/or opening elements, the interspaces between the teeth are rather ample on account of a relatively large or very large mutual distance of the teeth in connection with the tooth shape. Due to the interspace configuration, the waste particles in the presented fiber material preponderantly remain uncomminuted. Sufficient space is left for them to remain in the interspace between two successive teeth, without the particles being comminuted or broken. Further, they may be well discarded on the rear side of the roller-type metallic wire. Due to a relatively low tooth shape, the intended separation of waste particles is still intensified without their comminution or breaking. Uncomminuted waste particles may be well removed in unbroken condition from a convenient point of the metallic wire. The waste particles not being comminuted, not additional dust enters the fiber material and the fibers may be excellently dissolved to the finest condition with a simultaneous, substantially improved cleaning.

The undercut portion of the tooth tip suitably merges into a round shape to subsequently return over a short distance to the tooth base. The length of the transitional portion from the tooth tip to the tooth base is dictated by the angle position. As a matter of fact, the angle of the transitional portion to the horizontal line shall be situated within a range of 20 degrees to 40 degrees, preferably of about 28 degrees. Due to such a tooth shape and low tooth height, relatively long troughs are formed between the teeth arranged to be spaced widely mutually. On the one hand, such a lengthy trough offers sufficient space to accept relatively big waste particles in noncomminuted and unbroken condition. On the other hand, it is possible for such unbroken waste particles to drop out of the trough thus ensuring that the respective operative opening portion of the clothing is clean, i.e., completely free from impurities.

In view of the improved and intense cleaning effect in the sense of the invention, another feature resides in the fact that, as compared to known embodiments, the thickness of the toothed wire is relatively unimportant. If possible, it should not exceed 2 mm, the favorable range being situated between 1.7 mm to 1.85 mm. As a result, in a predetermined surface area, the number of tooth tips becoming effective is not inferior to that of the conventional wire design in which the succession of teeth is relatively close. The opening effect is not reduced this way.

It is advisable to take care that the height of the wire portion supporting the teeth and forming the tooth base is inferior to the tooth height. The height of the wire portion or of the continuous wire bar, is about two thirds of the tooth height. The wire will be stable and resistant thus ensuring a high opening and cleaning efficiency during a sufficient service life. The thickness of the tooth suitably corresponds to about half the thickness of the wire portion.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 1 shows an elevational view in stretched condition and a detail as well as a schematic view of one embodiment of the saw tooth wire according to the invention for a roller wire; and FIG. 2 shows a schematic elevational view of a specific embodiment of the saw tooth wire of the invention.

DESCRIPTION OF A PREFERRED EMBODIMENT

Referring now in more detail to the drawings, metallic wire for rollers processing textile fibers is illustrated as a saw tooth wire 1 consisting of a continuous wire bar 2 with teeth 3 arranged in a relatively largely spaced relationship. The distance 4 exceeds at least 12 mm and may be as large as about 30 mm. The rear part of teeth 3, as can best be seen in the elevational views is provided with an inclination 5 ascending flatly, if possible, while the front breast is provided with undercut surfaces 6 The front angle 7 may range between 10 degrees and 40 degrees. Preferably, the inclination 6 of the undercut portion is rounded and, subsequently, it may extend over a short oblique distance 8 as far as to the tooth base 9.

It is advantageous for the height 11 of the wire which carries teeth 3 to be lower than the height 12 of the tooth shape. The height of the wire portion 2 may be 0.6 to 0.8 of the tooth height. Between the widely spaced teeth 3, there is formed a gap or trough 13 of a considerable and important length adapted to accept waste particles which are not comminuted or broken during the opening operation.

FIG. 2 shows a preferred embodiment of the saw tooth wire of the invention. The detail shown of the toothed wire 15 comprises teeth 16 which should be spaced at a tooth distance 17 of at least 10 mm. A distance of 15 mm to 30 mm is considered an average measure. Height 18 of the tooth shape is within the range of up to one third of the tooth distance. A rear inclination 20 extends from the tooth base 19 to each tooth 16 and defines a low rear ascending portion which ascends over nearly half its way or somewhat thereover from the tooth base 19 to the tooth tip from where an undercut 21 is provided. The undercut inclination 22 forms with the rear inclination 20 a front angle 23 which may be kept within the range of 10 degrees to 40 degrees. The positive front angle may be in the preferred range between 26 degrees and 36 degrees. There follows a round portion 24 whereafter, on a short distance, a transitory inclination 25 extends as far as to the tooth base 19. Advantageously, the extension of the transitory portion 25 is relatively short. The advantageous angle 14 of the latter to the horizontal line, i.e., to the prolongation of the tooth base 19 should range between 20 degrees to 40 degrees, preferably at about 28 degrees. By this means, there is formed between teeth 16 a relatively long trough 26 extending to the tooth base 19 and being capable of receiving waste particles of a considerable length which are not broken. Further, a squeezing of the waste particles is substantially avoided in the trough. Advantageously, height 12,18 of teeth 3,16 is inferior to 3 mm and preferably within the range of 2 mm to 2.5 mm.

Since the tooth shape is relatively low, height 28 of the wire portion 29 carrying the teeth and forming the tooth base 19 may be inferior to the tooth height 18. The height of the wire portion 29 may be within the range of 0.5 to 0.7 of the tooth height 18. Preferably, height 28 occupies about two thirds of the tooth height 18. Due to the generally low toothed wire, the thickness of the wire portion 29 may be kept at a relatively reduced dimension and should not exceed 2 mm. The thickness of tooth 16 should be about half the thickness of the wire portion which may be within the range of 1 mm to 2 mm. The cross profile of teeth 16 and wire portion 29 is shown at 30. Taken in all, the resultant toothed wire has a considerable rigidity and stability.

The claimed wire may be used advantageously for high-speed rollers having a relatively small diameter for cleaning spinning material. The output or material throughput is high. The roller may be composed of plates including the disclosed tooth wire or it may be formed of a roller body having a smooth circumference on which a helically mounted toothed wire may be provided with the cleaning fittings under consideration.

While a preferred embodiment of the invention has been described using specific terms, such description is for illustrative purposes only, and it is to be understood that changes and variations may be made without departing from the spirit or scope of the following claims.

What is claimed is:

1. Metallic toothed wire for processing textile fibers having a wire portion, said toothed wire comprising:

a plurality of teeth having a tooth distance defined between adjacent teeth of at least 10 mm creating lengthy trough interspaces;

said teeth having a low height profile defined by an upper tooth tip which extends above a tooth base to a height of about one third of said tooth distance;

said tooth having a low rear inclination which ascends in a rear inclination over about half said tooth distance from said tooth base to said tooth tip;

an undercut having an undercut inclination extending downwardly from said tooth tip, said under cut inclination terminating at a transitory inclination which terminates at said tooth base;

a positive front angle between said rear inclination and said undercut inclination being within a range of 10 degrees to 40 degrees; and said low height profile and lengthy trough interspaces of said teeth being constructed and arranged to contain fiber material in said interspaces with waste particles generally unbroken with increased separation of said waste particles from said interspaces over the low height profile of said teeth.

2. The wire of in claim 1 wherein said tooth distance is within the range of 10 mm to 30 mm.

3. The wire of claim 2 wherein said tooth distance is about 20 mm to 25 mm.

4. The wire of claim 1 wherein said height of the teeth is a range of about 2 mm to 2.5 mm.

5. The wire claim 1 wherein said positive front angle is within a range of about 26 degrees to 36 degrees.

6. The wire of claim 1 wherein said undercut has a generally rounded portion extending from said undercut inclination, and said transitory inclination is generally straight and extends from said rounded portion to said tooth base.

7. The wire of claim 6 wherein a transitory angle between the transitory inclination and the horizontal is within a range of about 20 degrees to 40 degrees.

8. The wire of claim 7 wherein said transitory angle is preferably 28 degrees.

9. The wire of claim 1 wherein said thickness of the wire portion does not exceed 2 mm.

10. The wire of claim 9 wherein said thickness of the wire portion is within the range of 1 mm to 2 mm.

11. The wire of claim 1 wherein said height of the wire portion carrying the teeth and forming the base is less than said tooth height and said height of the wire portion is about two thirds of the tooth height.

12. The wire of claim 1 wherein said thickness of the tooth is about half the thickness of the wire portion.

13. Metallic toothed wire for processing textile fibers having a wire portion, said tooth wire comprising:

a plurality of teeth having a tooth distance between the teeth of at least 10 mm;

said teeth having a height which is substantially less than said tooth distance;

said teeth having a rear inclination which ascends in a rear inclination over about half said tooth distance from a tooth base to a tooth tip;

an undercut having an undercut inclination extending downwardly from said tooth tip, a generally round portion extending from said undercut inclination, and a transitory inclination extending downwardly from said round portion to said tooth base; and lengthy trough interspaces defined between said undercuts and tooth bases of adjacent ones of said teeth for receiving fibers of substantial length and waste particle in a generally unbroken and uncomminuted state.

14. The wire of claim 13 wherein said rear ascending portion has a low profile facilitating release and removal of said waste particles in said unbroken an uncomminuted condition from said trough interspaces at a convenient point of said wire.

15. Metallic toothed wire for elements processing textile fibers having a wire portion, said toothed wire comprising:

a plurality of teeth having a tooth distance defined between adjacent teeth of at least 10 mm creating lengthy trough interspaces;

said teeth having a low height profile defined by an upper tooth tip which extends above a tooth base to a height of less than about 3 mm;

said tooth having a low rear ascending portion which ascends in a rear inclination from said tooth base to said tooth tip; and said low height profile and lengthy trough interspaces of said teeth being constructed and arranged to contain fiber material in said interspaces with waste particles generally unbroken with increased separation of said waste particles from said interspaces over the low height profile of said teeth.

16. The wire of in claim 15 wherein said tooth distance is within the range of 10 mm to 30 mm.

17. The wire of claim 16 wherein said tooth distance is about 20 mm to 25 mm.

18. The wire of claim 15 wherein said height of the teeth is within a range of about 2 mm to 2.5 mm.

19. The wire of claim 15 wherein said thickness of the wire portion does not exceed 2 mm.

20. The wire of claim 19 wherein said thickness of the wire portion is within the range of 1 mm to 2 mm.

21. The wire of claim 15 wherein said height of the wire portion carrying the teeth and forming the base is less than said tooth height and said height of the wire portion is about two thirds of the tooth height.

22. The wire of claim 15 wherein said thickness of the tooth is about half the thickness of the wire portion.

* * * * *